US007246682B1

(12) United States Patent
Hatch

(10) Patent No.: US 7,246,682 B1
(45) Date of Patent: Jul. 24, 2007

(54) LADDER ELEVATOR DEVICE

(76) Inventor: Barlow Hatch, P.O. Box 701, Brookdale, CA (US) 95007

( * ) Notice: Subject to any disclaimer, the term of this patent is extended or adjusted under 35 U.S.C. 154(b) by 529 days.

(21) Appl. No.: 10/923,902

(22) Filed: Aug. 21, 2004

Related U.S. Application Data

(63) Continuation-in-part of application No. 10/180,822, filed on Jun. 25, 2002, now Pat. No. 6,782,972.

(51) Int. Cl.
*E04G 1/00* (2006.01)
*E06C 7/16* (2006.01)
*E06C 7/42* (2006.01)

(52) U.S. Cl. ..... 182/129; 182/102; 182/109; 182/107

(58) Field of Classification Search ..... 182/102, 182/103, 109, 107, 141, 129, 144, 207, 63.1, 182/68.1, 68.2, 180.3, 77, 76
See application file for complete search history.

(56) References Cited

U.S. PATENT DOCUMENTS 1,811,709 A * 6/1931 Bessler ..... 182/80
2,249,900 A * 7/1941 Honig ..... 182/68.3
2,551,036 A * 5/1951 Mills ..... 182/66.1
3,693,755 A * 9/1972 Terayama ..... 182/102
3,966,018 A * 6/1976 Kozai et al. ..... 182/103
4,183,423 A * 1/1980 Lewis ..... 182/103
4,706,779 A * 11/1987 Bono ..... 182/63.1
6,782,972 B1 * 8/2004 Hatch et al. ..... 182/102
6,802,392 B1 * 10/2004 Davis ..... 182/77
6,866,118 B1 * 3/2005 Battenberg ..... 182/77

* cited by examiner

*Primary Examiner*—Hugh B. Thompson, II
(74) *Attorney, Agent, or Firm*—The Kline Law Firm

(57) ABSTRACT

An elevator device that is installed on one or more ladders to lift loads from the ground to a desired position on a roof. A base securing device can be added to each of the ladders to insure stability. An outrigger mounted on a user's truck can be employed to further stabilize the ladders. The elevator device includes a ladder attachment assembly to affix the device to a ladder or ladders, a lateral travel section, and a roof top mounting device. A ladder stabilization bracket that affixes the ladder to a parapet or balcony can be employed for additional stability of the device. Several winch mechanisms are utilized to position the device and raise loads. The device can be easily adapted for use on flat roofs with a parapet through the addition of a ladder stabilization bracket. The elevator device can also readily be used on flat roofs without parapets, pitched roofs, and even to load trucks.

21 Claims, 6 Drawing Sheets

LADDER ELEVATOR DEVICE

This application is a continuation-in-part of the inventors' application Ser. No. 10/180,822, filed Jun. 25, 2002 now U.S. Pat. No. 6,782,972, which is hereby incorporated by reference in its entirety.

BACKGROUND OF THE INVENTION

1. Field of the Invention

The present invention relates generally to construction equipment, and more particularly is a ladder mounted elevator device to raise loads.

2. Description of the Prior Art

People in the construction and building service industries are well aware of the many items that need to be raised to the roofs of various structures. The most common items to be lifted are of course the items that are installed on the roofs—roofing materials and heating, ventilating, and air conditioning equipment. These items are usually far to heavy to simply be carried up a ladder by a workman.

Various pieces of equipment have been utilized to resolve the elevating problem, among them cranes, cherry pickers, and helicopters. While these machines are certainly effective in raising the required loads, they are also expensive to operate, sometimes prohibitively so. Moreover, these machines require operating manpower in addition to that required for the actual installation at hand.

The prior art discloses many devices that have been proposed to address the problems of raising loads to a rooftop or to another elevated location. Various ladder hoists, hoist attachments, and ladder attachments to facilitate lifting have been offered for use in the painting, maintenance, HVAC, and construction trades.

Many such devices are essentially winches attached to a ladder, such as the "Lifting Device for Use with a Ladder" by Campbell, U.S. Pat. No. 5,911,287, issued Jun. 15, 1999. Another such device is the "Ladder Hoist Attachment" of Larson, U.S. Pat. No. 4,598,795, issued Jul. 8, 1986. Still another is the "Stabilized Ladder Power Winch System" of Pate, U.S. Pat. No. 5,139,108, issued Aug. 18, 1992. Still another is the "Extension Ladder Hoist" of Ziegelmann, U.S. Pat. No. 4,128,228, issued Dec. 5, 1978.

Other lifting devices incorporate a ladder or a ladder-like element with a hoist support arrangement to yield a portable hoist. One such device is the "Lift and Portable Lift" of Krotov, et al., U.S. Pat. No. 5,427,356. A similar device is the "Portable Hoist" of Killeen, U.S. Pat. No. 4,690,248, issued Sep. 1, 1987. A device that connects the hoist support to the terminal end of a ladder is the "Portable Swiveling Lift Device" of Sears, U.S. Pat. No. 5,738,185, issued Apr. 14, 1998.

The lack of widespread use of these prior art devices is attributable to their having one or more of the following shortcomings: (1) insufficient anchoring of the base of the ladder; (2) insufficient stabilization of the portion of the ladder from which the lifting force is applied; (3) lack of a safe and secure means of securing the upper end of the ladder; (4) the failure to provide sufficient power and mechanical advantage to lift large loads; (5) lack of easy portability; and (6) lack of compatibility with existing ladders.

Accordingly, it is an object of the present invention to provide a ladder elevator device that can be affixed to a standard ladder.

It is another object of the present invention to provide a device that has a stable base.

It is still another object of the present invention to provide a device that has adequate means of securing the lifting device to the roof top or other elevated area.

It is yet another object of the present invention to provide a device that is easily portable, but has adequate lifting power.

These and other objects and advantages of the present invention will become apparent to those skilled in the art in view of the description of the best presently known mode of carrying out the invention as described herein and as illustrated in the drawings.

SUMMARY OF THE INVENTION

The present invention is an elevator device that is installed on a standard ladder, or for large lifting capacity installation, two or more ladders. In applications using two or more ladders, a base securing device can be added to each of the ladders to insure stability. An outrigger mounted on a user's truck can be employed to further stabilize the base.

The elevator device includes a ladder attachment assembly to affix the device to a ladder or ladders, a lateral travel section, and a roof top mounting device. A ladder stabilization bracket that affixes the ladder to a parapet or balcony can be employed for additional stability of the device.

Several winch mechanisms are utilized in the device. A first winch is mounted near a base of the ladder(s) to raise and lower the ladders. A second winch is mounted behind the ladders relative to a subject building to change the ladders' angles relative to a building. A third winch mounted on or near the second winch is used for setup of the device and to get small loads to the roof of the subject building. Finally, a fourth winch is mounted on the lateral travel section of the device. The fourth winch raises loads from the ground, and moves along the lateral travel section to provide lateral travel for the loads along the roof top. If desirable for a particular job, extension elements can be added to the lateral travel section so that the fourth winch extends further onto a roof to reduce transport labor.

The device can be easily adapted for use on flat roofs with a parapet through the addition of a ladder stabilization bracket. The elevator device can also readily be used on flat roofs without parapets, pitched roofs, and even to load trucks.

The ladder elevator device of the present invention will typically be operated by a handheld control panel. Depending on the preference of the user, a foot operated control panel is also provided.

Another useful implementation of the present invention that should be noted, apart from the main function of a single elevator raising a load, is that two of the elevator devices can be employed in tandem to form a convenient portable and automated scaffold device.

An advantage of the present invention is that it is easily attached to all common ladders.

Another advantage of the present invention is that it is sturdy enough to have a very large lifting capacity.

A still further advantage of the present invention is that it includes a means to move the load across a rooftop, rather than to just lift the load to the roof.

Still another advantage of the present invention is that it has a means to secure the travel section of the device securely on the rooftop or other elevated area.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

The present invention is an elevator device 10 that is installed on a standard ladder 12, or for a large lifting capacity installation, two or more ladders 12. In applications using two or more ladders 12, a base securing device 14 is added to each of the ladders 12 to insure stability.

Figure 1:
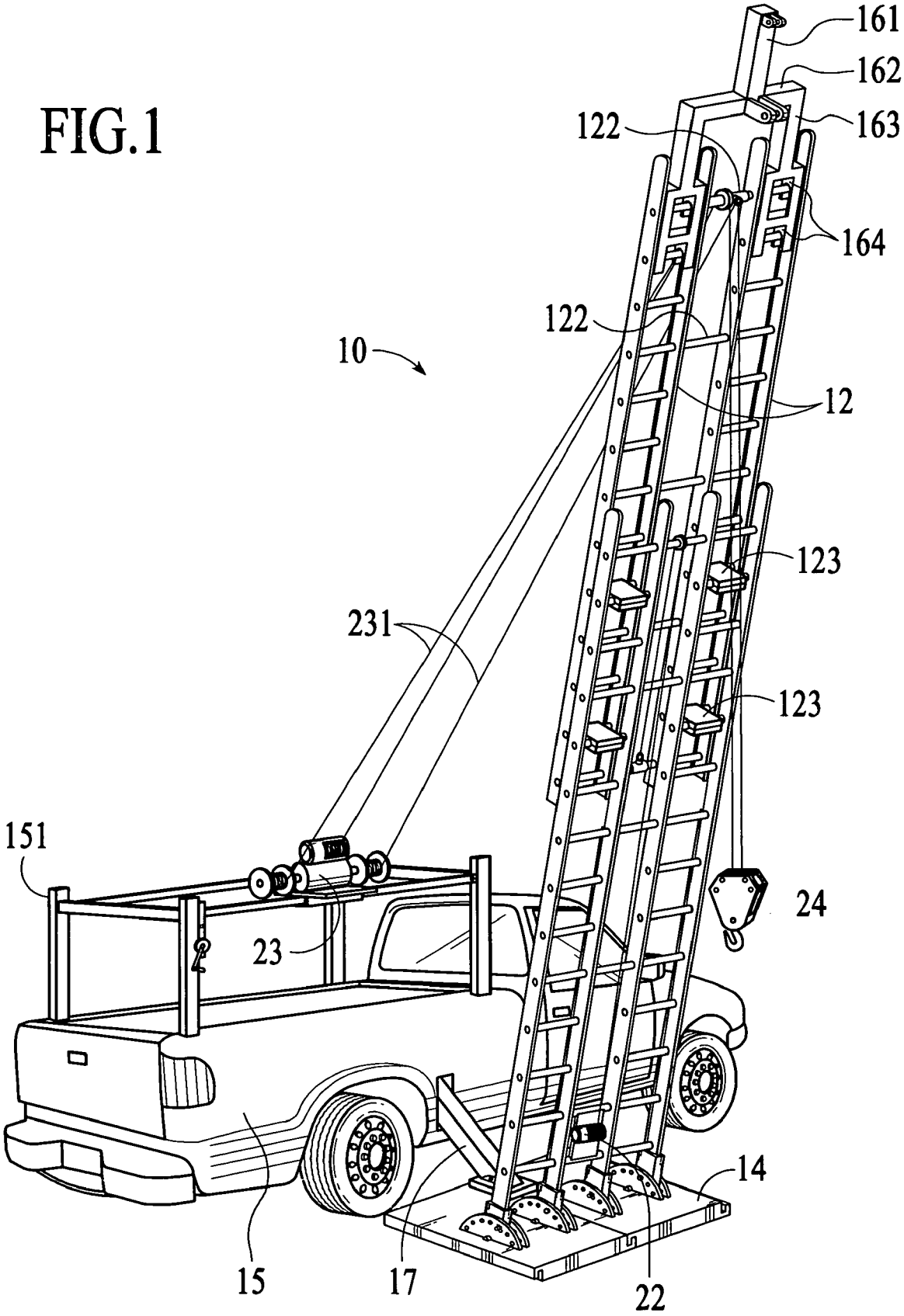
FIG. 1 is a perspective view of the ladder elevator device of the present invention mounted on a dual locked ladder base and a truck mounted outrigger in setup mode.

FIG. 1 illustrates the ladder elevator device 10 used in conjunction with a truck 15. A pair of extension ladders 12 with a dual locked ladder base securing device 14 is used to provide adequate support for the system. The base securing device 14 is further stabilized by an outrigger 17 extended from the truck 15.

Figure 5:
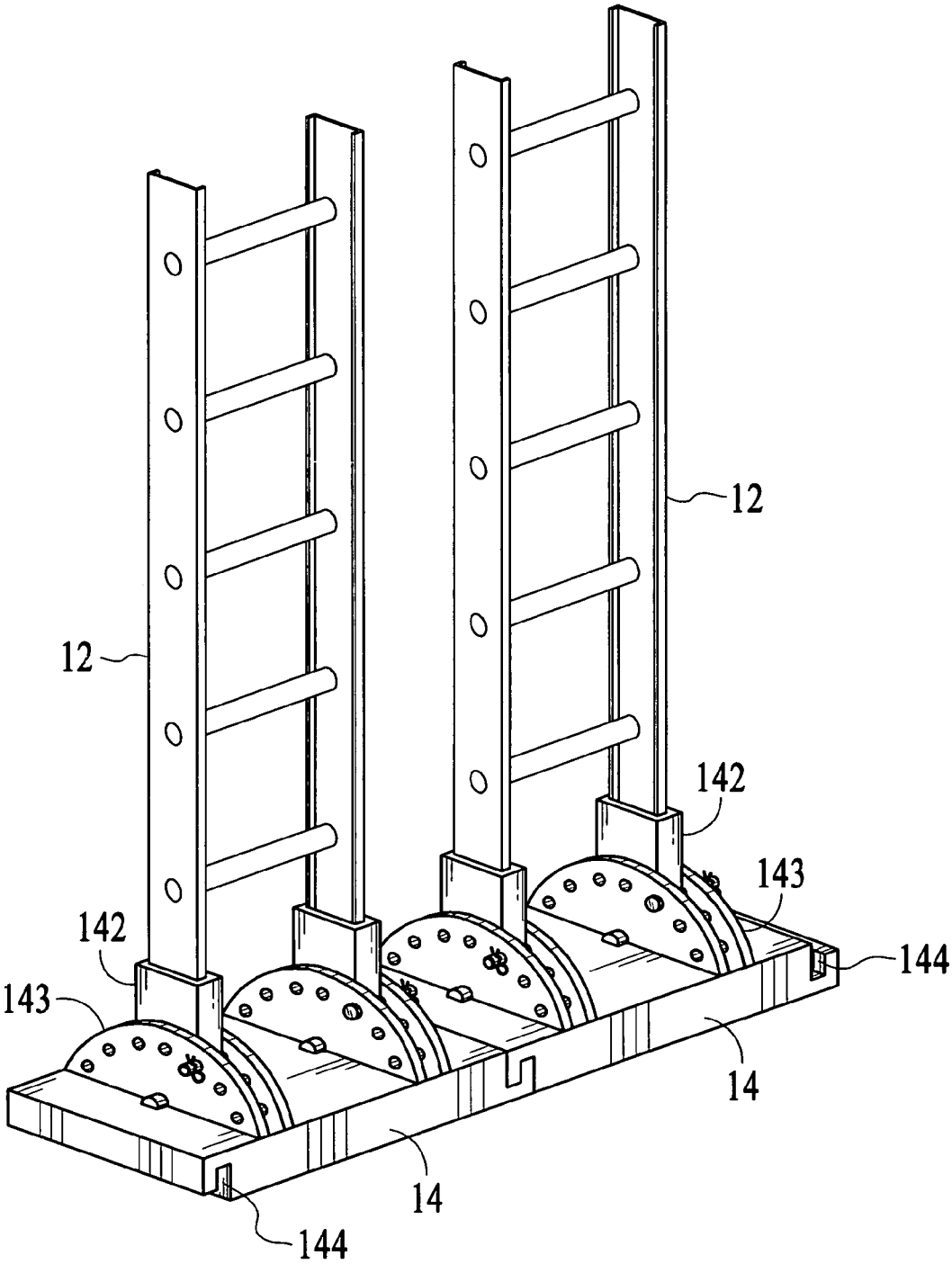
FIG. 5 is a perspective view of the ladder base securing device on a dual locked ladder base.
Figure 6:
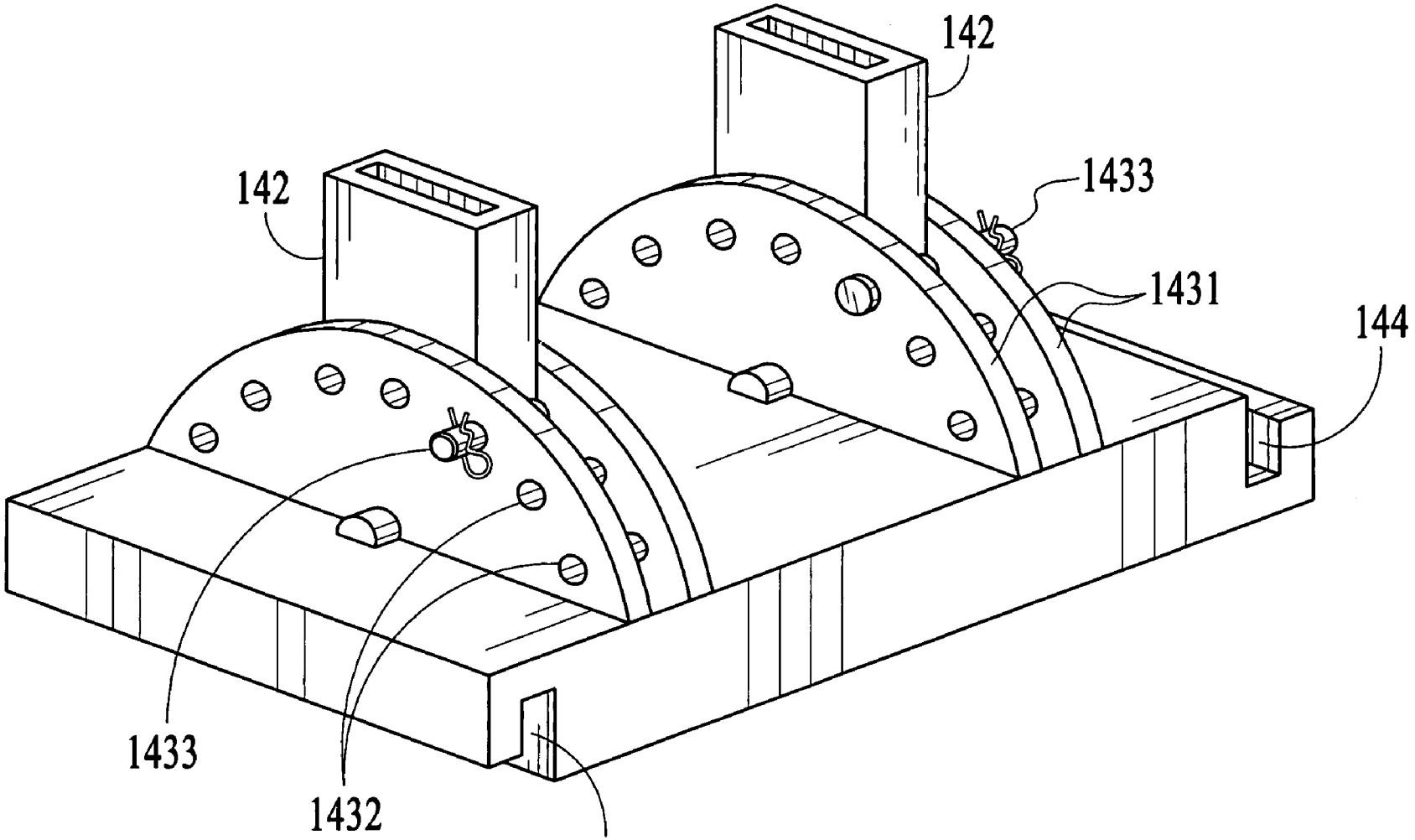
FIG. 6 shows a detached ladder base securing device.

The ladder base securing device 14 is shown in detail in FIGS. 5 and 6. The ladder base securing device 14 comprises a heavy base element 141 with a pair of ladder rail sockets 142 pivotally mounted thereon. The rail sockets 142 are contained in angle locking means 143. The angle locking means 143 comprise a pair of parallel semicircular plates 1431 with a plurality of locking positions defined therein. In the preferred embodiment, the locking positions are defined by a series of holes 1432 that selectively receive a locking pin 1433. The position of the locking pin 1433 defines the maximum angle through which the rail sockets 142, and hence the ladder rails, can be moved. Once the angle of installation is determined, the locking pin 1433 is inserted into the appropriate holes 1432, and the angle of inclination of the ladders 12 is fixed.

Adjacent pairs of the ladder base securing devices 14 are mated together by tongue and groove fixtures 144 situated at each end of the securing device 14. The tongue and groove fixtures 144 are in alternating orientations, that is, a right side tongue and groove fixture 144 has a groove open to a top side, while a left side tongue and groove fixture 144 has a groove open to a bottom side. This conformation allows the pairs of ladder base securing devices 14 to be securely locked together, so that the bases of the ladders 12 are very stable. While it is envisioned that not more than two ladders 12 will typically be used in a given application, it should be readily recognized that as many ladders 12 and corresponding ladder base securing devices 14 as the user desires may be chained together to provide as much elevator mounting stability as may be desired.

The ladders 12 are secured in the proper vertical position by rung latches 121 which prevent sections of each of the extension ladders 12 from moving relative to each other. The ladders 12 are secured laterally by one or more ladder rung joiners 122. The ladder rung joiners 122 are colinear with rungs of adjacent ladders 12, and serve as convenient mounting points for winches, winch cables, and the like. Upper ends of the ladders are also secured in position relative to each other by a ladder attachment assembly 16.

Figure 3:
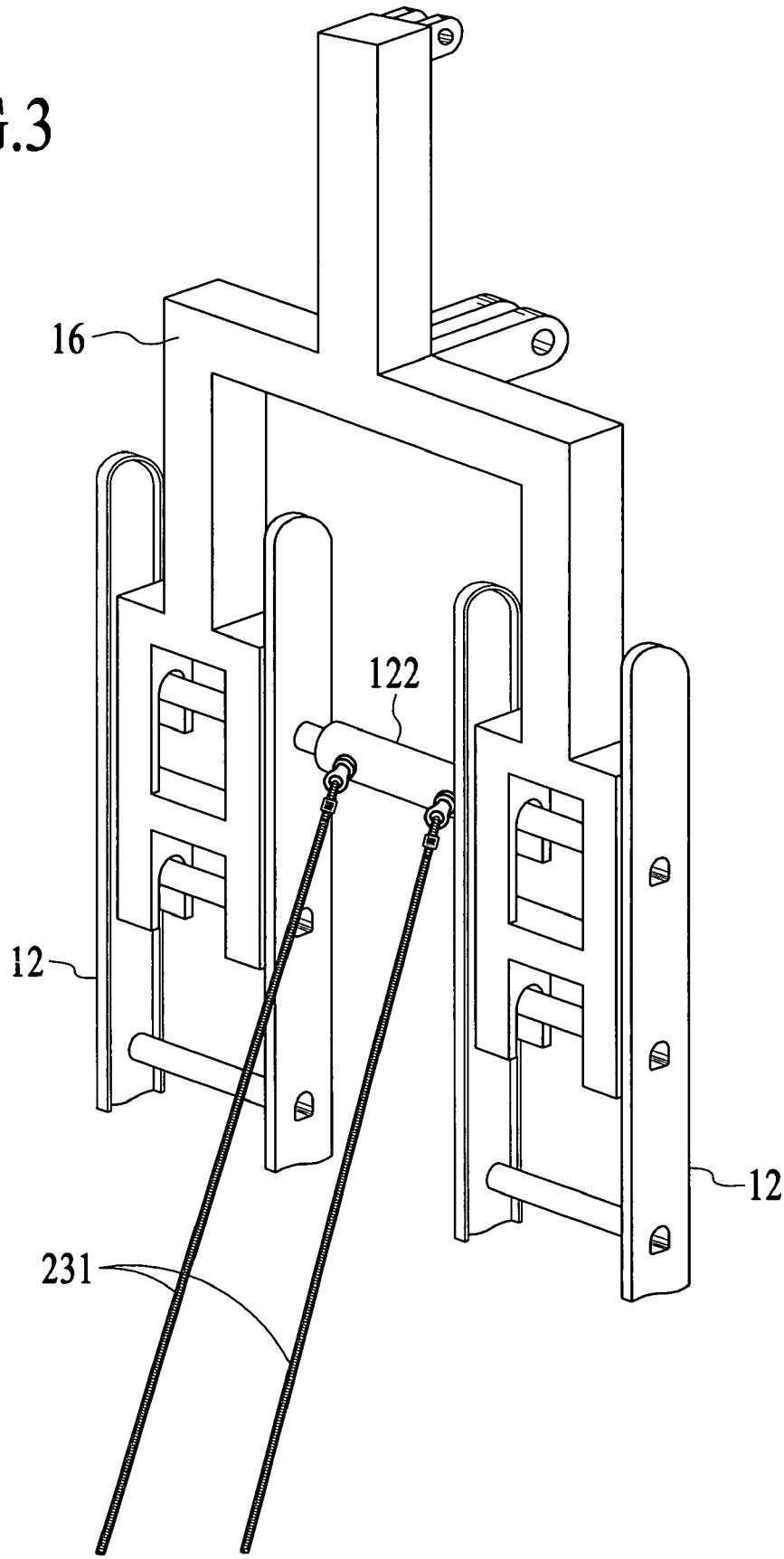
FIG. 3 is a detail perspective view showing the attachment of the lateral travel section fo the top ends of the ladders.

FIG. 3 illustrates the branched ladder attachment assembly 16 that is utilized to affix the lateral travel section 18 of the elevator device 10 to the ladders 12. The ladder attachment assembly 16 comprises an attachment arm 161 that is pivotally attached to the lateral travel section 18. (See FIG. 4.) The attachment arm 161 connects to a lateral branch arm 162. Two mounting arms 163 extend downward from the branch arm 162. The mounting arms 163 terminate in a rung attachment means 164.

The rung attachment means 164 comprises a plurality of rung hooks 1641 configured to fit over the rungs of the ladder 12. In the embodiment shown in FIG. 3, two sets of paired rung hooks 1641 are used, although as many pairs of hooks 1641 as are desired can of course be employed. It should also be evident to those skilled in the art that the rung hooks 1641 on the rung attachment means 164 need not be in pairs, but could be single elements, or in groups of three or more. However, at least two rungs of the ladders 12 should always be secured by the rung attachment means 164 of the ladder attachment assembly 16 so that the ladder attachment assembly 16 does not rotate about the end of the ladders 12.

Figure 2:
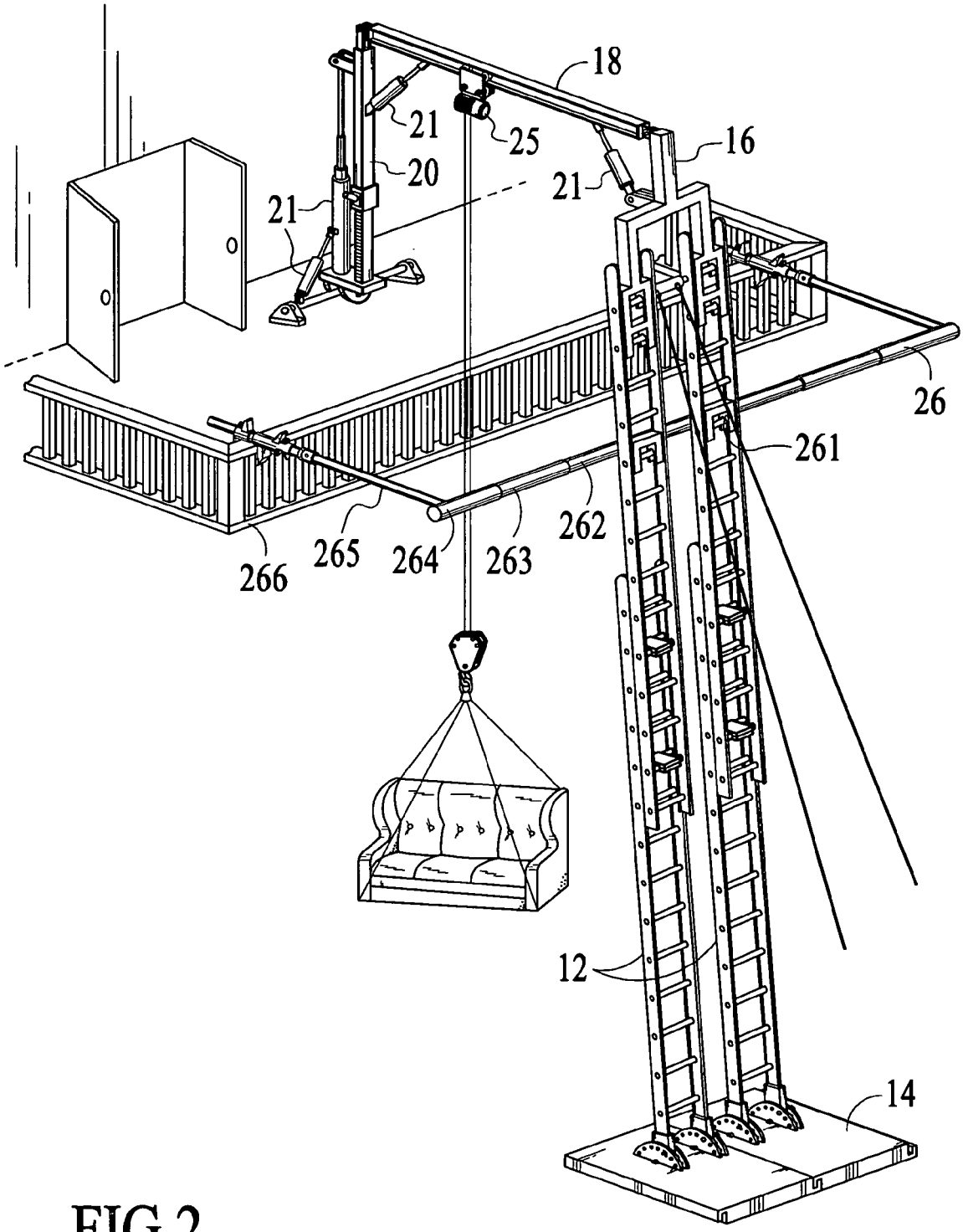
FIG. 2 is a perspective view of the ladder elevator device of the present invention mounted on a dual locked ladder base with a ladder stabilization bracket in use on a balcony.

The elevator device 10 shown in FIG. 2 also makes use of an optional telescoping ladder stabilization bracket 26. The dual ladder stabilization bracket 26 comprises two rung attachment means 261 to affix the bracket 26 to the ladder 12. The rung attachment means 261 are affixed to a central mounting bar 262. A plurality of nesting extension segments 263 are provided to extend the bracket 26 outward from the ladders 12. Clamping arms 265 are affixed to the terminal extension segments 263. The clamping arms 265 each terminate in clamping mechanisms 266 that secure the ladder stabilization bracket 26 to a parapet (as shown in FIG. 2), a balcony railing, or simply an edge of a roof.

Figure 4:
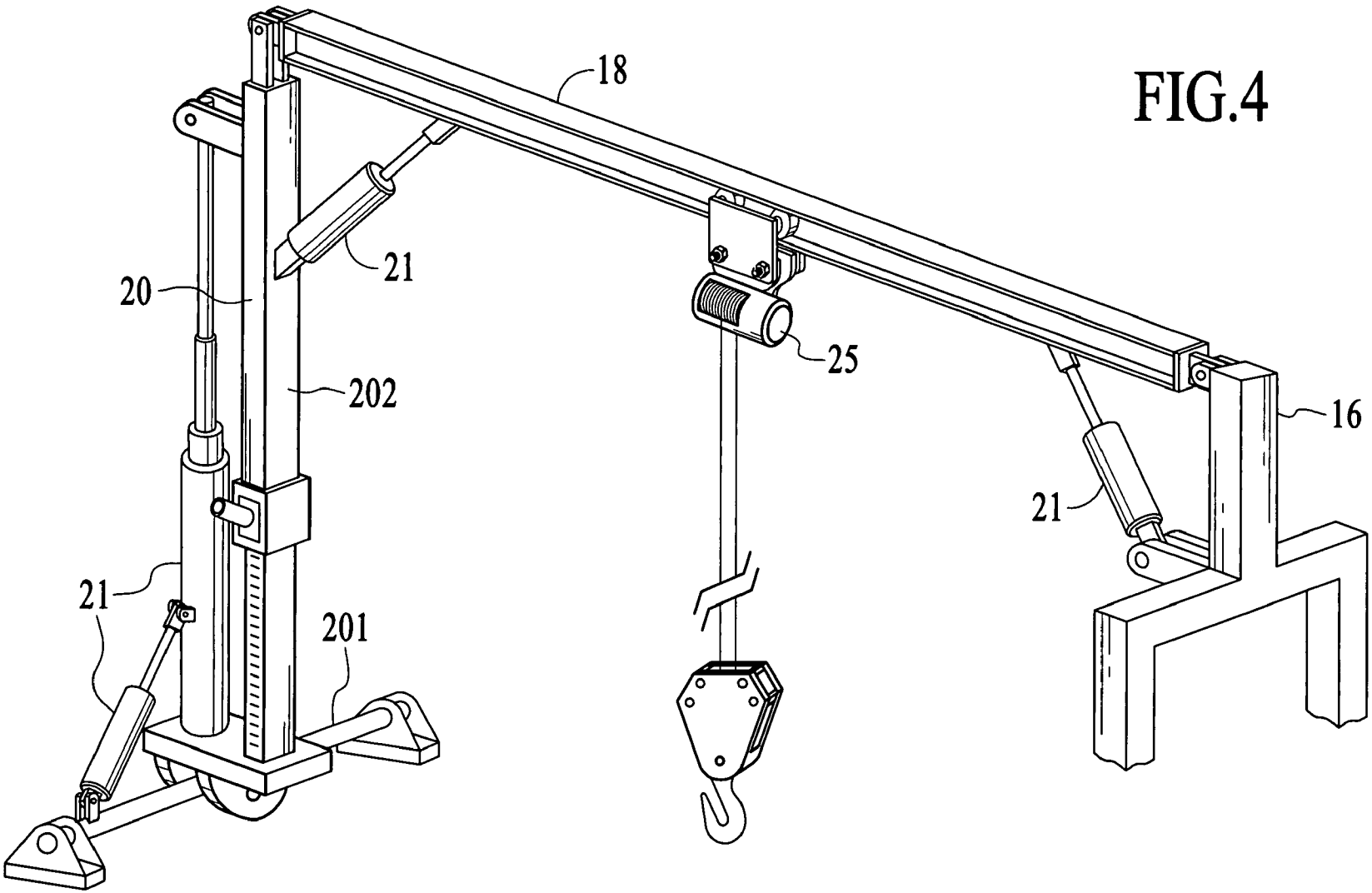
FIG. 4 is a perspective view of the lateral travel section and t-bar support.

Referring now chiefly to FIG. 4, the lateral travel section 18 comprises an I-beam main body. The lateral travel section 18 is pivotally attached at a first end to the ladder attachment assembly 16, and at a second end to a t-bar support 20. Positioning of the travel section 18 and the T-bar 20 relative to the ladders 12 and the roof of a building is controlled by a series of hydraulic cylinders 21. In the preferred embodiment, four cylinders 21 are utilized: one at each end of lateral travel section 18, one to control a height of the T-bar support 20, and one to control the angle of the base of the T-bar 201. The base 201 of the T-bar support 20 is pivotally attached to the main body 202 of the T-bar support 20.

The hydraulic cylinders 21 are critical to the operation of the elevator device 10 for several reasons. Most importantly, the hydraulic cylinders 21 allow secure and accurate positioning of the lateral travel section 18 and the T-bar support 20. In addition, the cylinders 21 allow a much lighter I-beam to be used for any given length of the lateral travel section 18. The I-beam is rated according to its support points. The support points of the I-beam of lateral travel section 18 are set in significantly from the ends of the I-beam, in that the support points are defined by the attachment points of the cylinders 21. For example, if a fifteen foot I-beam is used, and the hydraulic cylinders 21 are mounted two-and-a-half feet from the ends of the I-beam, the effective length of the I-beam is only ten feet. This allows a much lighter I-beam to be used for the desired travel length than would be required if the I-beam was mounted only at the ends of the travel path.

Referring now to FIGS. 1 and 4, the elevator device 10 can be operated and set up with a series of winches. A first winch 22 is mounted near the base of the ladders 12 and is used to raise and lower the extension portions of the ladders 12 depending on the height required for a job. A second winch 23 is mounted behind the ladders 12, and is used to fix the angles of the ladders 12. A user's truck rack 151 is a convenient location on which to mount the second winch 23. As detailed in FIG. 3, the second winch cables 231 are affixed to a rung joiner 122 between the two ladders 12. A third winch 24, which can be conveniently coupled with the second winch 23, is used to lift the lateral travel section 18, the T-bar support 20, and other light loads required for setup of the device 10. A fourth winch 25 is mounted on the lateral travel section 18, and is used to lift the main loads. The fourth winch 25 is provided with a wheels 251 that are received in the I-beam of the lateral travel section. This enables the fourth winch 25 to lift loads from the ground, and then move the loads to the place on the roof where the load is required.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A ladder elevator device comprising:

at least one ladder, a base to secure said ladder, a lifting device mounted on said ladder, said lifting device having a capacity to raise and lower a load, a winch in communication with an upper end of said ladder such that operation of said winch changes an angle between said ladder and said base, and a ladder stabilization bracket, said ladder stabilization bracket comprising:

at least one rung attachment means that secures said ladder stabilization bracket to said at least one ladder, a central mounting bar affixed to said rung attachment means, telescoping extension segments that extend outward from said central mounting bar when said extension segments are deployed, clamping arms attached to terminal units of said extension segments, and clamping mechanisms affixed to distal ends of said clamping arms; wherein said ladder stabilization bracket is affixed to said ladder below said ladder attachment assembly, and said clamping arms pivot about a longitudinal axis of said ladder stabilization bracket, said clamping mechanisms are secured to a member of said work area surface to further stabilize and secure said ladder elevator device.

2. The ladder elevator device of claim 1 wherein said device further comprises:

at least one ladder attachment assembly, a lateral travel section, a vertical support member, and a raising, lowering, and laterally transporting device that travels back and forth on said lateral travel section and has a capacity to raise and lower a load; wherein said ladder attachment assembly secures said lateral travel section to said ladder;

said lateral travel section is pivotally attached to said ladder attachment assembly such that an angle between said lateral travel section and said ladder attachment assembly is variable, and said vertical support means is pivotally attached to said lateral travel section such that an angle between said vertical support member and said lateral travel section is variable; so that said vertical support member rests on a work area surface and supports said lateral travel section in a substantially horizontal orientation.

3. The ladder elevator device of claim 2 wherein:

said ladder attachment assembly comprises at least two rung attachment means that secure said ladder attachment assembly to rungs of said ladder.

4. The ladder elevator device of claim 3 wherein:

said rung attachment means each comprise a pair of rung hooks.

5. The ladder elevator device of claim 1 wherein:

said base to secure said ladder comprises:

a base element, a pair of ladder rail sockets that receive a lower end of side rails of said ladder, and an angle locking means; wherein said angle locking means secures said ladder at an optimal angle relative to an installation surface for a given installation.

6. The ladder elevator device of claim 5 wherein:

each said angle locking means comprises:

a pair of parallel semicircular plates, a series of holes in said semicircular plates, and a locking pin that is inserted into one of said holes in said semicircular plates such that said locking pin contacts said side rails of said ladder so that said ladder is held at said optimal angle.

7. The ladder elevator device of claim 5 wherein:

each said base element comprises a tongue and groove fixture in each of two opposing sides thereof, said tongue and groove fixtures being in reverse orientation such that a left side tongue and groove fixture of a first unit of said base element meshes with a right side tongue and groove fixture of a second unit of said base element so that said first and second units of said base element are serially joined.

8. A ladder elevator device comprising:

at least one ladder, a base to secure said ladder, a lifting device mounted on said ladder, said lifting device having a capacity to raise and lower a load, and a winch in communication with an upper end of said ladder such that operation of said winch changes an angle between said ladder and said base, at least one ladder attachment assembly, a lateral travel section, a vertical support member, and a raising, lowering, and laterally transporting device that travels back and forth on said lateral travel section and has a capacity to raise and lower a load; wherein said ladder attachment assembly secures said lateral travel section to said ladder;

said lateral travel section is pivotally attached to said ladder attachment assembly such that an angle between said lateral travel section and said ladder attachment assembly is variable, and said vertical support means is pivotally attached to said lateral travel section such that an angle between said vertical support member and said lateral travel section is variable; so that said vertical support member rests on a work area surface and supports said lateral travel section in a substantially horizontal orientation.

9. The ladder elevator device of claim 8 wherein:

said ladder elevator device further includes a ladder stabilization bracket, said ladder stabilization bracket comprising:

at least one rung attachment means that secures said ladder stabilization bracket to said at least one ladder, a central mounting bar affixed to said rung attachment means, telescoping extension segments that extend outward from said central mounting bar when said extension segments are deployed, clamping arms attached to terminal units of said extension segments, and clamping mechanisms affixed to distal ends of said clamping arms; wherein said ladder stabilization bracket is affixed to said ladder below said ladder attachment assembly, and said clamping arms pivot about a longitudinal axis of said ladder stabilization bracket, said clamping mechanisms are secured to a member of said work area surface to further stabilize and secure said ladder elevator device.

10. The ladder elevator device of claim 8 wherein:

said ladder attachment assembly comprises at least two rung attachment means that secure said ladder attachment assembly to rungs of said ladder.

11. The ladder elevator device of claim 10 wherein:

said rung attachment means each comprise a pair of rung hooks.

12. The ladder elevator device of claim 8 wherein:

said base to secure said ladder comprises:

a base element, a pair of ladder rail sockets that receive a lower end of side rails of said ladder, and an angle locking means; wherein said angle locking means secures said ladder at an optimal angle relative to an installation surface for a given installation.

13. The ladder elevator device of claim 12 wherein:

each said angle locking means comprises:

a pair of parallel semicircular plates, a series of holes in said semicircular plates, and a locking pin that is inserted into one of said holes in said semicircular plates such that said locking pin contacts said side rails of said ladder so that said ladder is held at said optimal angle.

14. The ladder elevator device of claim 13 wherein:

each said base element comprises a tongue and groove fixture in each of two opposing sides thereof, said tongue and groove fixtures being in reverse orientation such that a left side tongue and groove fixture of a first unit of said base element meshes with a right side tongue and groove fixture of a second unit of said base element so that said first and second units of said base element are serially joined.

15. A ladder elevator device comprising:

at least one ladder, a base to secure said ladder, a lifting device mounted on said ladder, said lifting device having a capacity to raise and lower a load, and a winch in communication with an upper end of said ladder such that operation of said winch changes an angle between said ladder and said base; wherein said base to secure said ladder comprises:

a base element, a pair of ladder rail sockets that receive a lower end of side rails of said ladder, and an angle locking means; wherein said angle locking means secures said ladder at an optimal angle relative to an installation surface for a given installation.

16. The ladder elevator device of claim 15 wherein said device further comprises:

at least one ladder attachment assembly, a lateral travel section, a vertical support member, and a raising, lowering, and laterally transporting device that travels back and forth on said lateral travel section and has a capacity to raise and lower a load; wherein said ladder attachment assembly secures said lateral travel section to said ladder;

said lateral travel section is pivotally attached to said ladder attachment assembly such that an angle between said lateral travel section and said ladder attachment assembly is variable, and said vertical support means is pivotally attached to said lateral travel section such that an angle between said vertical support member and said lateral travel section is variable; so that said vertical support member rests on a work area surface and supports said lateral travel section in a substantially horizontal orientation.

17. The ladder elevator device of claim 16 wherein:

said ladder attachment assembly comprises at least two rung attachment means that secure said ladder attachment assembly to rungs of said ladder.

18. The ladder elevator device of claim 17 wherein:

said rung attachment means each comprise a pair of rung hooks.

19. The ladder elevator device of claim 15 wherein:

said ladder elevator device further includes a ladder stabilization bracket, said ladder stabilization bracket comprising:

at least one rung attachment means that secures said ladder stabilization bracket to said at least one ladder, a central mounting bar affixed to said rung attachment means, telescoping extension segments that extend outward from said central mounting bar when said extension segments are deployed, clamping arms attached to terminal units of said extension segments, and clamping mechanisms affixed to distal ends of said clamping arms; wherein said ladder stabilization bracket is affixed to said ladder below said ladder attachment assembly, and said clamping arms pivot about a longitudinal axis of said ladder stabilization bracket, said clamping mechanisms are secured to a member of said work area surface to further stabilize and secure said ladder elevator device.

20. The ladder elevator device of claim 15 wherein:

each said angle locking means comprises:

a pair of parallel semicircular plates, a series of holes in said semicircular plates, and a locking pin that is inserted into one of said holes in said semicircular plates such that said locking pin contacts said side rails of said ladder so that said ladder is held at said optimal angle.

21. The ladder elevator device of claim 15 wherein:

each said base element comprises a tongue and groove fixture in each of two opposing sides thereof, said tongue and groove fixtures being in reverse orientation such that a left side tongue and groove fixture of a first unit of said base element meshes with a right side tongue and groove fixture of a second unit of said base element so that said first and second units of said base element are serially joined.

* * * * *